US005268024A

United States Patent [19]

Moran

[11] Patent Number: 5,268,024

[45] Date of Patent: Dec. 7, 1993

[54] FORMATION OF INORGANIC CONDUCTIVE COATINGS ON SUBSTRATES

[75] Inventor: William P. Moran, Tulsa, Okla.

[73] Assignee: Rockwell International Corporation, Seal Beach, Calif.

[21] Appl. No.: 922,220

[22] Filed: Jul. 31, 1992

[51] Int. Cl.[5] ..... C23C 18/00

[52] U.S. Cl. ..... 106/1.27; 106/1.26; 106/1.18; 106/1.17; 252/518; 252/519

[58] Field of Search ..... 106/1.27, 1.26, 1.18, 106/1.19, 20 B, 25 R; 252/518, 519

[56] References Cited

U.S. PATENT DOCUMENTS

| | | | |
|---|---|---|---|
| 5,002,824 | 3/1991 | Warren | 427/126.2 |
| 5,041,306 | 8/1991 | Warren | 427/126.1 |
| 5,156,672 | 10/1992 | Bishop | 106/1.17 |
| 5,158,604 | 10/1992 | Morgan et al. | 106/1.26 |

*Primary Examiner*—Helene Klemanski
*Attorney, Agent, or Firm*—Charles T. Silberberg; Max Geldin

[57] ABSTRACT

Precursor formulation for producing conductive coatings, e.g. nickel sulfide, on substrates such as fiberglass, comprising a soluble metal salt such as nickel acetate, a sulfur donor such as thiourea, a suitable solvent such as water or methanol, and a thickening agent to increase the viscosity of the precursor solution, such as the polyester formed by incorporating ethylene glycol and citric acid, or by addition of xanthan gum, into the precursor formulation. By employing a combination of xanthan gum and locust bean gum the precursor solution can be converted to a gel form. The conversion of the precursor composition into a thickened or gelled form facilitates its application in desired amount and without undue evaporation of solvent, onto a preselected area of the substrate, to form conductive patterns or gradients by various printing processes such as the gravure and transfer processes. Upon heating the coated substrate to a temperature which reacts the metal salt and the sulfur donor of the precursor coating to form the conductive metal sulfide, e.g. nickel sulfide, on the substrate, the polyester or gum additive is pyrolyzed and is substantially removed from the conductive coating.

16 Claims, No Drawings

FORMATION OF INORGANIC CONDUCTIVE COATINGS ON SUBSTRATES

BACKGROUND OF THE INVENTION

This invention relates to an improved process for applying inorganic conductive coatings on substrates, and is particularly concerned with procedure for modifying the physical properties, particularly the viscosity, of precursor solutions to facilitate application of metal sulfide, e.g. nickel sulfide, conductive coatings or conductive patterns on substrates.

As disclosed in U.S. Pat. Nos. 5,002,824 and 5,041,306, both to Warren, electrically conductive inorganic coatings can be applied to a substrate such as fiberglass fabric by contacting the substrate, as by dipping or spraying, with a precursor solution of a metal salt, such as nickel sulfate, and a sulfur donor such as thiourea. The resulting treated substrate is then dried and heated to form an electrically conductive metal sulfide, e.g. nickel sulfide, adherent coating or pattern on the substrate, while preserving the physical properties.

The addition of other ingredients to the precursor solution can adjust the conductivity and improve the mechanical properties, e.g. shelf-life stability, of the deposited conductive film. Selective patterning of such conductive films or coatings can be achieved by various printing processes, and also such conductive coatings have application on components for controlling electromagnetic fields, such as aircraft edge surfaces, e.g. the edges of wings.

The above noted precursor solution when applied to a substrate, evaporates prior to reaction of the components therein to form the conductive metal sulfide. Particularly when employing spraying as the means for applying the precursor solution to a substrate for producing conductive patterns, it is difficult to control the evaporation rate. Control of electrical conductivity of the deposited metal sulfide requires that the mass of the precursor material which is applied to a substrate be carefully controlled. Control of the mass of the coating is often desired in order to achieve some other property than electrical conductivity, such as weight, color, depth or thickness.

An improved method for applying the precursor which will provide better control of mass transfer of precursor and of placement of electrically conductive patterns on a substrate is desirable. Conventional methods such as spraying and dipping are not able to provide the predictability in this respect that is required.

It is an object of the invention to provide an improved precursor solution of a metal salt and a sulfur donor, for production of a conductive coating on a substrate, providing better control of mass transfer of the precursor and of the placement of conductive coatings and patterns on a substrate.

Another object is to increase the viscosity of the precursor solution and control the evaporation rate of the solution, particularly when applied by spraying, to facilitate application and control of the conductive film on the substrate, particularly for the production of conductive patterns, or to function as an ink in the screen or gravure processes, or in film transfer processes.

A still further object is to control the fluid properties, including viscosity and wetting power, of the above precursor solution.

Yet another object is to provide a procedure for applying the improved precursor solution to a substrate to provide a controlled conductive coating or pattern.

Other objects and advantages of the invention will appear hereinafter.

SUMMARY OF THE INVENTION

The above objects are achieved according to the invention by the incorporation of certain thickening agents, for example the polyester produced by reaction of ethylene glycol and citric acid, in the aqueous or non-aqueous precursor solution of a metal salt, such as a nickel salt, and a sulfur donor, such as thiourea. The mixture of ethylene glycol and citric acid reacts directly in the precursor solution to form a polyester. Since both of these reactants are multifunctional, the ester bonds they form create a network in the solution which increases the viscosity thereof with only small amounts of the polymer present.

Other thickening agents such as a suitable gum, particularly xanthan gum, can alternatively be employed. The addition of a galactomannan such as locust bean gum to the xanthan gum produces a gel which can be cast into a film.

The conversion of the precursor solution to a thickened solution or to a gel holds the metal salt and sulfur donor compounds in homogeneous solution or suspension in the precursor solution, preventing evaporation of the solvent during application of the precursor to a substrate, particularly when applied by spraying, and preventing separation of such compounds from the solvent medium. Thus, when such compounds are subsequently chemically reacted to form a conductive coating or pattern on the substrate, the compounds are completely reacted, and the conductive material is completely formed in place on the substrate.

The thickened precursor solution can be applied as by spraying on a non-porous or porous substrate such as woven reinforcing fibers, e.g. fiberglass, or cast as a film on a substrate, and the deposited coating or film is heated to cause reaction of the metal salt, e.g. nickel sulfate, and the sulfur donor, e.g. thiourea, to develop or form a conductive coating or preselected pattern of selected conductivity and shape in place on the substrate. By employing a thickened precursor solution, the amount and concentration of the precursor solution applied to the substrate surface can be more readily controlled. The thickened precursor of the invention also facilitates application of uniform or graded conductive layers or coatings. Upon heating the thickened or gelled precursor on the substrate to form conductive metal sulfide, e.g. nickel sulfide, the organic components, namely the polyester and the gum or gums, are volatilized and substantially removed.

The thickened or gelled precursor concept of the invention can be applied as a printing ink to various printing processes such as gravure printing, and as a film former for the transfer process.

Broadly, then, the invention according to one aspect comprises a precursor formulation for producing a conductive coating comprising a solution containing a soluble nickel salt capable of being converted to nickel sulfide, a sulfur donor, a solvent for said nickel salt and said sulfur donor, and a material incorporated in said solvent and capable of increasing the viscosity of the precursor formulation, and capable of forming a thickened solution which holds the nickel salt and the sulfur donor in solution or suspension during application of such formulation to a substrate, such material being substantially fugitive when the substrate containing said formulation is heated to form a conductive nickel sulfide on the substrate, the nickel sulfide being substantially free from the viscosity increasing material.

According to another aspect, the invention embodies a process for applying a conductive coating on a substrate which comprises providing a thickened precursor formulation as defined above, applying the thickened formulation to a selective area of a substrate, drying the resulting coating and heating the resulting coated substrate for a time sufficient to form a conductive metallic sulfide coating substantially free from the viscosity increasing material.

DETAILED DESCRIPTION OF THE INVENTION AND PREFERRED EMBODIMENTS

The precursor solution for producing the electrically conductive coating consists of a solution of a soluble metal salt and a sulfur donor.

The nickel salts employed in the precursor solution can include nickel sulfate, nickel chloride, nickel acetate, nickel nitrate, nickel tetrafluoroborate, and the like. The concentration of the nickel salt in the treating solution can range from about 0.01 to about 2 molar.

The sulfur donor or sulfur releasing substance can include an alkali metal thiosulfate, such as sodium and potassium thiosulfate, ammonium thiosulfate, thioacetamide, thiophosphate salts such as sodium thiophosphate and ammonium thiophosphate, thiourea, and the like. The concentration of the sulfur donor in the treating solution is generally within the same range of concentration as the concentration of the nickel salt.

Either aqueous treating solutions of the soluble nickel salt and sulfur donor, or organic solutions, e.g. methanol solutions, can be employed.

The electrically conductive nickel sulfide coated substrates or composites can be produced by contacting a dielectric non-porous or porous dielectric substrate, of the types noted below, such as fiberglass fabric, with the above aqueous or non-aqueous precursor solution, drying the resulting wet substrate at ambient temperature, and heating the resulting substrate at elevated temperature of about 100° C. to about 400° C. to produce electrical conductivity.

The above process for producing conductive nickel sulfide coated substrates is described in the above U. S. patents and is incorporated herein by reference. As noted therein, the nickel sulfide conductive coating formed therein is formulated as $NiS_x$ rather than pure NiS, due to its apparently polymeric nature.

A non-porous or a porous dielectric material is employed as a substrate for deposition of the conductive coating. Thus, a porous dielectric or electric insulating material can be used as substrate, such as a porous ceramic, a porous glass, e.g. a frit, a porous organic foam, e.g., polyurethane, a fabric, which can be woven or non-woven, e.g., fiberglass fabric, a mixed oxide fabric, such as an alumina-silica-boria fabric, e.g. Nextel, or the silicon carbide fabric marketed as Nicalon, or a synthetic organic fabric, such as Kevlar, a trademark of the DuPont Company for aromatic polyamide fiber, a polyester such as Dacron cloth or Mylar, a polyimide such as Kapton, marketed by DuPont, and the like. Glass and polyimide sheets and composites can also be employed.

The present invention provides a modification of the above precursor solution which achieves better control of mass transfer and of the placement of conductive patterns on a substrate by the above process. Conventional methods such as spraying and dipping are not able to provide the predictability required. The primary feature which separates the present process from prior art processes dealing in precision mass transfer is the fluid properties of the precursor solution. The choice of substrate is limited only by the requirement that the substrate survive the heat treatment necessary to form the conductive coating. Thus the substrate may be any of the non-porous or porous, woven or non-woven, materials exemplified above.

This feature is accomplished according to the present invention by increasing the viscosity of the precursor solution, by incorporating certain thickeners therein, to thereby provide better control of the mass transfer and spreading of the precursor. A further feature is the control of the evaporation rate of the solvent. Such thickening agents hold the soluble metal salt, e.g. nickel salt, and the sulfur donor in homogeneous suspension during application of the precursor solution to the substrate, so that when such components are reacted the conductive coating or material is formed in place.

One preferred thickening agent for this purpose is the polyester formed in the precursor solution by incorporating therein ethylene glycol and citric acid. These components react to form a chain polymer which increases the viscosity of the solution, and are compatible with the solvent system, i.e. water or organic solvent such as methanol, and with the metal ions in solution. The polymer forms in the precursor solution under normal conditions. Raising the temperature of the precursor solution increases the reaction rate but is not required. The ratio of ethylene glycol to citric acid employed ranges from about 0.5 to 1 part of ethylene glycol per 1 part of citric acid, e.g. approximately equal weight amounts, and the amounts of such reactants employed is such as to form a polyester in an amount of about 1 to about 5% by weight of the precursor solution. These materials are compatible with the solvent system, e.g. water or methanol, and with the metal ions in solution. The resulting thickened precursor solution can be applied to a substrate such as fiberglass by spraying or doctor blade, or can be applied to a substrate by an ink-jet application device, or by a gravure printing cylinder.

Another preferred thickening agent are the gum polymers, particularly xanthan gum, marketed as Kelzan-S by Kelco Division of Merck and Co. When employing Xanthan gum, water is used as solvent in the precursor solution. The xanthan gum is employed in an amount ranging from about 0.03% to about 2% by weight of the precursor solution. Similarly to the polyester, use of xanthan gum as thickener produces a viscous precursor solution which can be applied to a substrate such as fiberglass, by spraying, doctor blade or by gravure printing cylinder. The natural tendency for thiourea to complex with the metal ions retards any reaction between such ions and the gum, permitting the metal ions to be used up to the maximum concentrations.

According to another feature, a galactomannan such as locust bean gum is employed in combination with xanthan gum. The addition of locust bean gum to the xanthan gum converts the precursor solution to a gel, which can be cast into a film if desired. The total amount of xanthan gum and locust bean gum can range from about 0.03% to about 2.0%, preferably about 1%, by weight of solution. The proportion of xanthan gum to locust bean gum can range from about 1:4 to about 4:1, preferably employing about equal proportions, by weight. The incorporation of the above combination of gums in the precursor solution renders the latter particularly useful for making a transferable film for use in transfer type applications as well as printing type applications.

After application of the thickened or gelled precursor solution to a substrate, the resulting coated substrate is dried at ambient or somewhat elevated temperatures, followed by heating at higher temperatures of about 100° C. to about 400° C., to form the conductive nickel sulfide. The polyester and gum thickening agents, present in small quantities, are burned away during the pyrolysis, so that the resulting conductive nickel sulfide coating is substantially free of these organic materials, although it is understood that small amounts or trace residues of such components may remain in the conductive coating.

If desired, small amounts, e.g. 5% by weight of precursor solution, of chelating agents such as diethylenetriamine (DETA) can be added with the above xanthan gum, or to its combination with locust bean gum to form a strong complex with the nickel ions. This protects the gel structure from collapse due to the ionic attractron of the nickel ion.

Also, the addition of wetting agents such as Gafax 610, marketed by GAF Corporation, believed to be a polyethoxy castor oil, can be added to the polyester or gum embodiments, in an amount, e.g. of about 0.1% by volume of the precursor solution, to increase the wetting of the substrate by the precursor formulation.

The improved thickened or gelled precursor formulations of the invention are useful for producing conductive sheet products for the control of electromagnetic fields. Examples of uses of the conductive material include shielding D.C. and low frequency circuits such as communications and entertainment equipment, absorbing electromagnetic waves, and protecting sensitive circuits. Conductive films produced according to the invention are also useful for application to the wings of aircraft. The conductive material produced according to the invention process is suited to any application that requires a controlled electrical resistance or conductivity.

The following are examples of practice of the invention.

EXAMPLE 1

Production of a conductive sheet on woven structural fiberglass

The following precursor solution is prepared:

| COMPOSITION A | |
|---|---|
| COMPONENTS | AMOUNT |
| nickel acetate monohydrate | 448 g. |
| thiourea | 137 g. |
| GAFAX 610 wetting agent | 3 g. |
| water | 3,000 ml |
| Kelzan-S gum | 1% by wt. |

The above thickened precursor solution has a viscosity of about 5000 cp.

This thickened fluid is applied to a web of woven fiberglass by a gravure printing cylinder or by an offset printing cylinder. The viscosity of the fluid is such that the fibers are wetted and the fluid blends into a connected phase before the solvent evaporates.

The web is dried at about 120° F. (49° C.) and then sent through a heat zone at about 2 feet per minute. The heat is sufficient to raise the web to 500° F. (260° C.) before the material has moved 0.5 inch into the zone. Speed and heat flux are directly proportional. Under these heating conditions an electrically conductive nickel sulfide develops on the fiberglass web. The electrical properties of the coating are measured on the moving web by a microwave transmissometer. This information is used to adjust the printing process (mass transfer) and the heat and speed in the development zone.

EXAMPLE 2

Production of a coating on a Kapton film substrate for transfer to another substrate for production of controlled conductivity The following precursor solution is prepared:

| COMPOSITION B | |
|---|---|
| COMPONENTS | AMOUNT |
| nickel acetate monohydrate | 448 g. |
| thiourea | 137 g. |
| GAFAX 610 wetting agent | 3 g. |
| water | 3,000 ml |
| Kelzan-S gum | 0.5% |
| locust bean gum | 0.5% |

The above precursor formulation is in the form of a gel having a Bloom gel strength (gms) for a 1 inch plunger of about 60 grams.

This gelled precursor solution is applied to a Kapton film substrate by doctor blade. The gel coating is dried to a tacky state at about ambient temperature. This pattern is then transferred to a woven fiberglass substrate by application of pressure. The gel may be cut into patterns before transfer. The coated fiberglass is conditioned at a controlled humidity of 30–70% relative humidity. The coating is then heated in an oven at about 500° F. (260° C.) with a moving heat source, as in Example 1, to develop an electrically conductive nickel sulfide coating.

EXAMPLE 3

The following precursor solution is prepared:

| COMPONENTS | AMOUNT |
|---|---|
| COMPOSITION C | |
| nickel acetate | 448 g. |
| thiourea | 137 g. |
| GAFAX 610 wetting agent | 3 g. |
| Polymer solution D below | 60 g. |
| methyl alcohol | 3,000 ml |
| POLYMER SOLUTION D | |
| ethylene glycol | 128 g. |
| citric acid | 128 g. |
| methyl alcohol | 300 ml |

The above thickened precursor solution has a viscosity of about 50 cp.

This polyester-containing precursor solution is applied to a fiberglass substrate through an "ink jet" application device to establish a pattern and to adjust the mass transfer per unit area. The coated pattern is dried and then heated to about 500° F. (260° C.) to develop a corresponding conductive nickel sulfide pattern.

EXAMPLE 4

The procedure of Example 1 is substantially followed using Composition C instead of Composition A, but wherein a substantially larger amount, 600 gms, of Polymer Solution D is employed, so as to increase the viscosity of the precursor solution to about 500 cp.

Substantially the same results are obtained as in Example 1.

It will be understood that other soluble metal salts, such as soluble copper or silver salts can be employed in the precursor solution in place of soluble nickel salts. However, the use of soluble nickel salts to produce conductive nickel sulfide coatings on substrates is preferred.

From the foregoing, it is seen that the invention provides an improved precursor solution containing a soluble metal salt, e.g. nickel salt, and a sulfur donor for forming conductive metal sulfide coatings, which is thickened or gelled to facilitate its application in providing preselected conductive coatings or patterns on substrates in various processes including gravure printing, the "ink-jet" process and the transfer process. The so modified precursor solution can be applied as by spraying, while controlling evaporation, to form the desired amount of conductive coating in place on a preselected area of the substrate.

Since various changes and modifications can be made in the invention without departing from the spirit of the invention, the invention is not to be taken as limited except by the scope of the appended claims.

What is claimed is:

1. A precursor formulation for producing a conductive coating, comprising a solution of
   - a soluble nickel salt capable of being converted to nickel sulfide,
   - a sulfur donor,
   - a solvent for said nickel salt and said sulfur donor, and
   - a material incorporated in said solvent and capable of increasing the viscosity of said formulation, said material employed in an amount effective to form a thickened solution which holds said nickel salt and said sulfur donor in solution or suspension during application of said formulation to a substrate, said material being substantially fugitives when said substrate containing said formulation is heated to form a conductive nickel sulfide on said substrate, said nickel sulfide being substantially free from said material.

2. The formulation of claim 1, wherein said soluble nickel salt is selected from the group consisting of nickel sulfate, nickel chloride, nickel acetate, nickel nitrate and nickel tetrafluoroborate, and said sulfur donor is selected from the group consisting of alkali metal and ammonium thiosulfates, alkali metal and ammonium thiophosphate, thiourea, and thioacetamide.

3. The formulation of claim 2, wherein said soluble nickel salt is nickel acetate and said sulfur donor is thiourea.

4. The formulation of claim 1, said solvent being water or methyl alcohol.

5. The formulation of claim 1, said material selected from the group consisting of a polyester, and a gum.

6. The formulation of claim 5, said polyester being formed by incorporating ethylene glycol and citric acid in said solution, and said gum being xanthan gum.

7. The formulation of claim 6, employing said xanthan gum, and in an amount ranging from about 0.03% to about 2% by weight of said solution, employing water as solvent.

8. The formulation of claim 6, employing said xanthan gum, and including adding locust bean gum to said solution, the total amount of xanthan gum and locust beam gum ranging from about 0.03% to about 2.0% by weight of the solution, employing water as solvent.

9. The formulation of claim 8, the proportion of xanthan gum to locust bean gum ranging from about 1:4 to about 4:1, by weight.

10. The formulation of claim 6, and including adding a wetting agent in said solution in a small amount effective to increase the wetting of said substrate by said formulation.

11. The formulation of claim 10, said wetting agent being a polyethoxy castor oil.

12. The formulation of claim 7 and including adding a chelating agent to said solution in a small amount effective to form a strong complex with the nickel ions.

13. The formulation of claim 12, said chelating agent being diethylenetriamine.

14. A precursor formulation for producing a conductive coating, comprising a solution of
   - a soluble metal salt selected from the group consisting of a soluble nickel salt, a soluble copper salt and a soluble silver salt capable of being converted to the corresponding metal sulfide,
   - a sulfur donor,
   - a solvent for said metal salt and said sulfur donor, and
   - a material incorporated in said solvent and capable of increasing the viscosity of said formulation, said material employed in an amount effective to form a thickened solution which holds said metal salt and said sulfur donor in solution or suspension during application of said formulation to a substrate, said material being substantially fugitive when said substrate containing said formulation is heated to form a conductive metal sulfide on said substrate, said metal sulfide being substantially free from said material.

15. A precursor formulation for producing a conductive coating, comprising a solution of
   - a soluble nickel salt capable of being converted to nickel sulfide,
   - a sulfur donor,
   - a solvent for said nickel salt, and said sulfur donor, and
   - a material incorporated in said solvent and capable of increasing the viscosity of said formulation, said material being capable of forming a thickened solution which holds said nickel salt and said sulfur donor in solution or suspension during application of said formulation to a substrate, said material being substantially fugitive when said substrate containing said formulating is heated to form a conductive nickel sulfide on said substrate, said nickel sulfide being substantially free from said material.

said material being a polyester formed by incorporating ethylene glycol and citric acid in said solution, the weight ratio of ethylene glycol to citric acid ranging from 0.5 to 1 part of ethylene glycol per 1 part citric acid, and forming a polyester in an amount of about 1 to about 5% by weight in said solution.

16. The formulation of claim 15, said ethylene glycol and said citric acid being present in approximately equal weight amounts.

* * * * *